US009255709B2

(12) United States Patent
Yim

(10) Patent No.: US 9,255,709 B2
(45) Date of Patent: Feb. 9, 2016

(54) AUTOMATIC WATER SUPPLY-TYPE STEAM GENERATOR USING VAPOR PRESSURE

(76) Inventor: Joo Hyuk Yim, Daejeon (KR)

( * ) Notice: Subject to any disclaimer, the term of this patent is extended or adjusted under 35 U.S.C. 154(b) by 54 days.

(21) Appl. No.: 13/977,270

(22) PCT Filed: Dec. 28, 2011

(86) PCT No.: PCT/KR2011/010266
§ 371 (c)(1),
(2), (4) Date: Jun. 28, 2013

(87) PCT Pub. No.: WO2012/091470
PCT Pub. Date: Jul. 5, 2012

(65) Prior Publication Data

US 2013/0284122 A1 Oct. 31, 2013

(30) Foreign Application Priority Data

Dec. 28, 2010 (KR) ..... 10-2010-0136553
Feb. 17, 2011 (KR) ..... 10-2011-0014264

(51) Int. Cl.
*F22D 5/26* (2006.01)
*F22D 5/28* (2006.01)

(52) U.S. Cl.
CPC ..... *F22D 5/28* (2013.01)

(58) Field of Classification Search
USPC ..... 122/414, 435, 442, 444, 452, 451.2, 122/459; 392/397, 400
See application file for complete search history.

(56) References Cited

U.S. PATENT DOCUMENTS 4,878,457 A * 11/1989 Bekedam ..... 122/441
6,196,163 B1 * 3/2001 Shah ..... 122/40
8,581,151 B2 * 11/2013 Miller ..... 219/399

FOREIGN PATENT DOCUMENTS

| | | |
|---|---|---|
| CN | 2230869 Y | 7/1996 |
| JP | 2002-327930 | 11/2002 |
| KR | 20-1985-0001370 | 7/1985 |
| KR | 20-1985-0001874 | 8/1985 |
| KR | 20-0367359 | 11/2004 |
| KR | 20-0421079 | 7/2006 |
| KR | 10-0836450 | 6/2008 |
| KR | 10-2009-0045899 | 5/2009 |

OTHER PUBLICATIONS

International Search Report for PCT/KR2011/010266 mailed Aug. 27, 2012.

* cited by examiner

*Primary Examiner* — Gregory A Wilson
(74) *Attorney, Agent, or Firm* — AKC Patents, LLC; Aliki K. Collins

(57) ABSTRACT

The present invention relates to an automatic water supply-type steam generator using vapor pressure for creating the optimum vacuum pressure inside a pressurized water supply tank, and for smoothly providing water to the pressurized water supply tank by using the strong aspiration force that is created by means of the vacuum pressure while continuously generating steam. The present invention is characterized by allowing control of the vacuum pressure to the optimum state when creating the vacuum pressure inside the pressurized water supply tank by introducing an adequate amount of outside air from the atmosphere through an air vent. In addition, the present invention is characterized by providing a means for cooling the pressurized water supply tank so as to control the vacuum pressure inside the tank to the optimum state.

20 Claims, 6 Drawing Sheets

AUTOMATIC WATER SUPPLY-TYPE STEAM GENERATOR USING VAPOR PRESSURE

RELATED APPLICATIONS

This application is a 371 application of International Application No. PCT/KR2011/010266, filed Dec. 28, 2011, which in turn claims priority from Korean Patent Application Nos. 10-2011-0014264, filed Feb. 17, 2011, and 10-2010-0136553, filed Dec. 28, 2010, each of which is incorporated herein by reference in its entirety.

TECHNICAL FIELD

The present invention relates to an automatic water supply-type steam generator using a vapor pressure which makes it possible to generate the optimum vacuum pressure in the interior of a pressurization water supply tank using a vapor pressure and to continuously generate necessary steam while reliably supplying water to the pressurization water supply tank with the aid of a strong suction force which is generated by the vacuum pressure.

BACKGROUND ART

A steam generator is configured in such a way that a water level detection sensor detecting the level of water is installed in a steam tank which helps generate and store steam by boiling water using various energy source (heater, waste heat, etc.). When the water level lowers and the water level in the steam tank reaches a set minimum water level, the water level detection sensor detects such state, and a water supply control valve installed at a water supply tube automatically opens, so water can be supplied to the steam tank.

The above mentioned conventional steam generator needs an additional electric motor pump so as to supply new water to the steam tank unless water is supplied with a natural pressure based on an elevation difference between upper and lower positions because the water supply tank is provided at the top of the steam tank.

Since the interior of the steam tank maintains a high pressure itself, even when the water supply tank is provided at the top, water supply is not reliably performed. So as to overcome the above mentioned problems, it needs to install a motor pump with a large capacity, which is costly in installing related facilities, and it entails more electric power for the sake of a start and operations of a motor pump, so it is hard to obtain a high energy efficiency and operation performance, and the maintenance of such facilities is disadvantageously costly.

Therefore, it urgently needs to develop a technology of generating the optimum vacuum pressure in the interior of the pressurization water supply tank using a vapor pressure and of reliably supplying water to the pressurization water supply tank with a strong suction force generated by the vacuum pressure.

DISCLOSURE OF INVENTION

Accordingly, it is an object of the present invention to provide an automatic water supply-type steam generator using a vapor pressure which makes it possible to adjust a vacuum pressure in the optimum state by introducing a proper amount of external air from the air through an air vent when generating a vacuum pressure in the interior of the pressurization water supply tank.

It is another object of the present invention to provide an automatic water supply-type steam generator using a vapor pressure which makes it possible to adjust the vacuum pressure in the optimum state by adjusting a vacuum pressure generation time in the interior of the pressurization water supply tank.

To achieve the above objects, there is provided an automatic water supply-type steam generator using a vapor pressure in which a condensation water collection tank configured to collect spent steam is connected to a pressurization water supply tank through a water supplement tube in which a water supplement control valve is installed, and the pressurization water supply tank is connected to a steam generator through a vapor pressure supply tube in which a pressure supply control valve is installed, and the pressurization water supply tank is connected to a steam generator or a portion where a supplied water is actually used, through a water supply tube in which a water supply control valve is installed. An air vent with a vacuum pressure adjustment valve is branched and installed at the water supplement tube.

In addition, a coolant spray tube configured to spray coolant into the interior of the pressurization water supply tank is connected to the interior of the pressurization water supply tank.

Advantageous Effects

The present invention ensures a generation of vacuum pressure in the interior of a pressurization water supply tank using vapor pressure for thereby sucking water from a condensation water collection tank using a strong suction force generating thanks to the vacuum pressure and automatically supplementing into the pressurization water supply tank and reliably supplying the water from the pressurization water supply tank to the steam generator, so it is possible to continuously and effectively supply necessary vapor.

In addition, even though the above mentioned effects are obtained, various kinds of large capacity pumps are not necessary like the conventional art, so the costs for related facilities can be considerably saved, and unnecessary power consumption required for the above mentioned operations can be avoided in the present invention, which results in enhancing the efficiency and operation performance of energy, and maintenance costs can be saved.

In addition, the problems of the conventional art which used to happen as the vacuum pressure is applied even into the interior of the steam tank can be completely overcome in the present invention in such a way to freely adjust the vacuum pressure forming in the interior of the pressurization water supply tank, thus maintaining a constant level of vacuum.

BEST MODES FOR CARRYING OUT THE INVENTION

Figure 1:
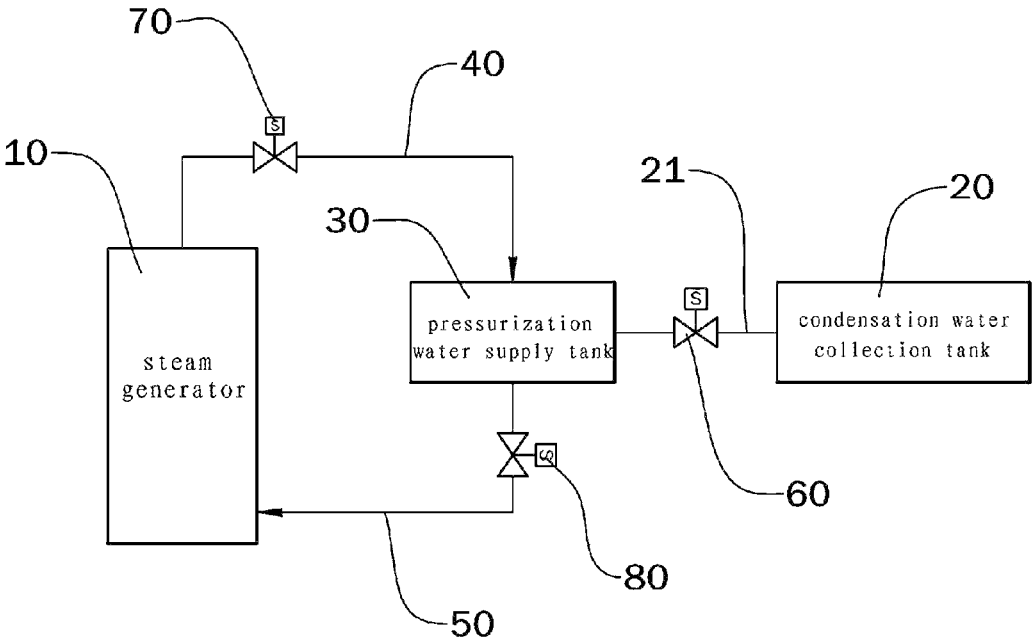
FIG. 1 is a block diagram illustrating in whole the entire constructions of an automatic water supply-type steam generator according to the present invention.

The whole technical construction according to a preferred embodiment of the present invention will be described in details. There are provided a condensation water collection tank 20 which collects spent steam; a pressurization water supply tank 30 which is installed through the condensation water collection tank 20 and a water supplement tube 21; a vapor pressure supply tube 40 connected between the pressurization water supply tank 30 and a steam generator 10; a water supply tube 50 which is connected either between the pressurization water supply tank 30 and the steam generator 10; a water supplement control valve 60 installed at a pipe conduit of the water supplement tube 21; a pressure supply control valve 70 which is installed at a pipe conduit of the vapor pressure supply tube 40; a water supply control valve 80 which is installed at a pipe conduit of the water supply tube 50; and an air vent 90 which is branched and installed at the water supplement tube 21 so as to adjust an internal vacuum pressure of the pressurization water supply tank 30 and which has a vacuum pressure adjusting valve 95 which is installed at a pipe conduit. All the above described elements are organically connected.

In addition, a coolant spray tube 98 is organically engaged and connected to the interior at the top of the pressurization water supply tank 30, the coolant spray tube 98 being configured to automatically spray coolant when the vapor pressure full in a vapor layer 31 of the pressurization water supply tank 30 is all discharged to the condensation water collection tank 20.

The steam generator 10 according to the present invention serves to generate and store vapor by boiling water using various energy sources such as a direct energy from a heater installed in the interior and an energy from a waste heat or a power plant which energy is generally discarded.

Once the vapor generating from the steam generator 10 is used for various purposes, the spent vapor is all collected into the condensation water collection tank 20, thus minimizing the loss of energy. The condensation water collection tank 20 is connected to the pressurization water supply tank 30 through the water supply tube 21 for thereby supplementing the condensation water of the condensation water collection tank 20 to the pressurization water supply tank 30. A water supply pipe 22 with a level regulating valve 22*a* is connected to the interior so that condensation water can be supplemented, as much as the amount of vapor which naturally vaporize, to the condensation water collection tank 20.

Figure 2:
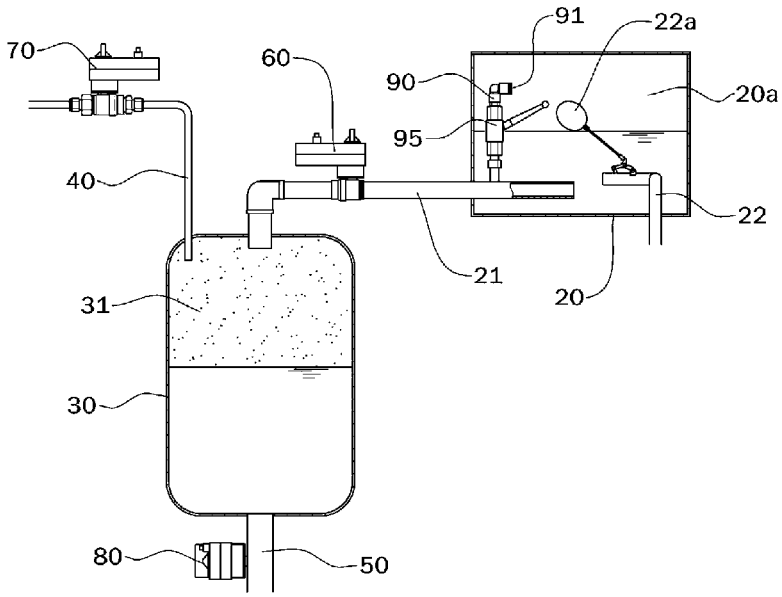
FIG. 2 is a vertical cross sectional view illustrating the installed states of a condensation water collection tank, a pressurization water supply tank and an air vent according to the present invention.
Figure 3:
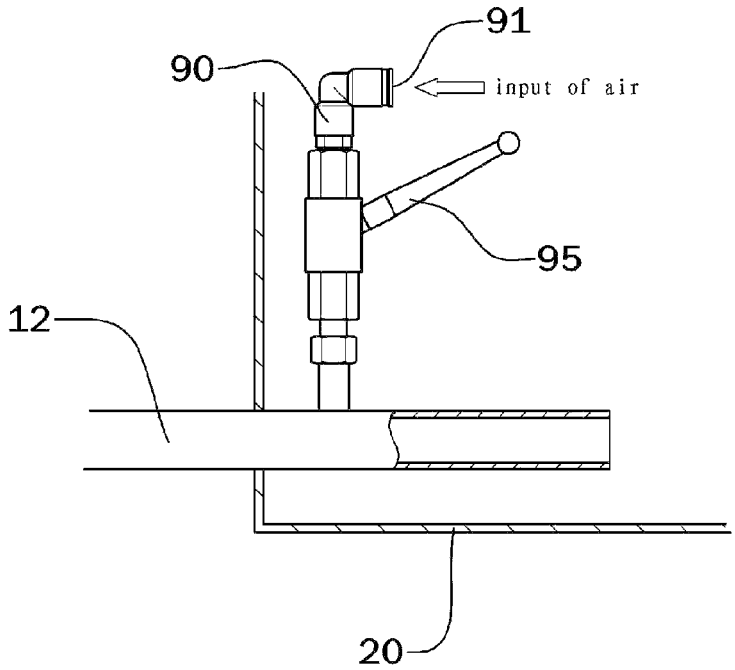
FIG. 3 is an enlarged cross sectional view illustrating an installed state of an air vent according to the present invention.

As shown in FIGS. 1 and 2, a vapor pressure supply tube 40 is connected to and installed between the pressurization water supply tank 30 and the steam generator 10, and a water supply tube 50 is connected to and installed between the pressurization water supply tank 30 and the steam generator 10, so that part of high pressure vapor can be supplied to the pressurization water supply tank 30.

The present invention has features in that part of the vapor pressure stored in the steam generator 10 is supplied to the pressurization water supply tank 30, so the internal pressure of the steam generator 10 becomes identical with the internal pressure of the pressurization water supply tank 30 for thereby more efficiently and effectively supplying the water stored in the pressurization water supply tank 30 to the steam generator 10, as a result of which additional large capacity pumps are not necessary in the above procedures.

At a pipe passage of the water supplement tube 21 is installed a water supplement control valve 60, and at a pipe passage of the vapor pressure supply tube 40 is installed a pressure supply control valve 70, and at a pipe passage of the water supply tube 50 is installed a water supply control valve 80, so that each flow passage can be automatically turned on or off depending on a selective operation of the controller, which consequently provides convenience when in use.

As shown in FIG. 2, one side of the water supplement tube 21 according to the present invention is connected to the pressurization water supply tank 30 in a water follow-possible way, and the other side of the same is arranged to submerge in the water in the condensation water collection tank 20, with the front end of the submerged portion being open.

Figure 4:
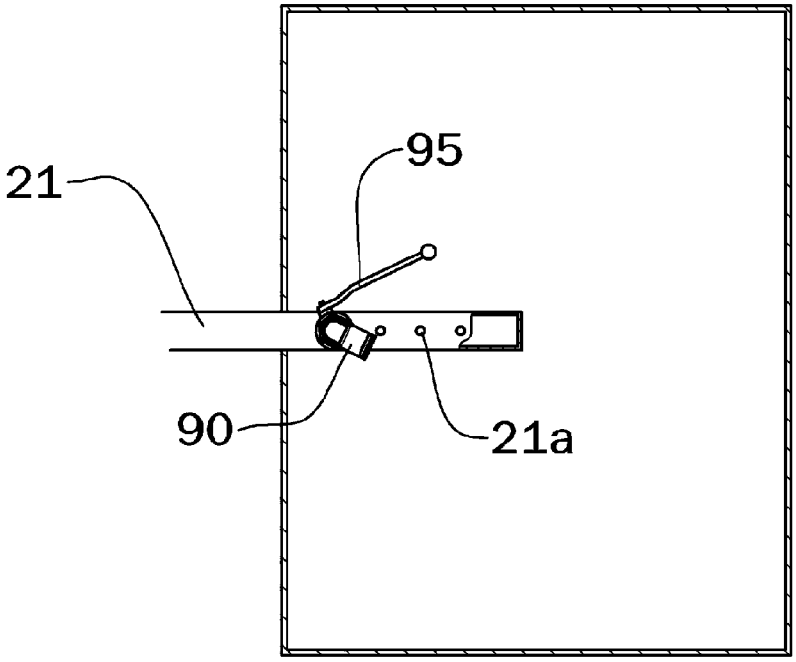
FIGS. 4 to 6 are plane views illustrating a state that a water supplement tube is connected to the interior of a condensation water collection tank according to the present invention.

As shown in FIG. 4, the other side of the water supplement tube 21 of the present invention is arranged to submerge in the interior of the condensation water collection tank 20 and the front end of the submerged portion is sealed, and a plurality of nozzle holes 21*a* are provided on its outer surface at regular intervals.

Figure 5:
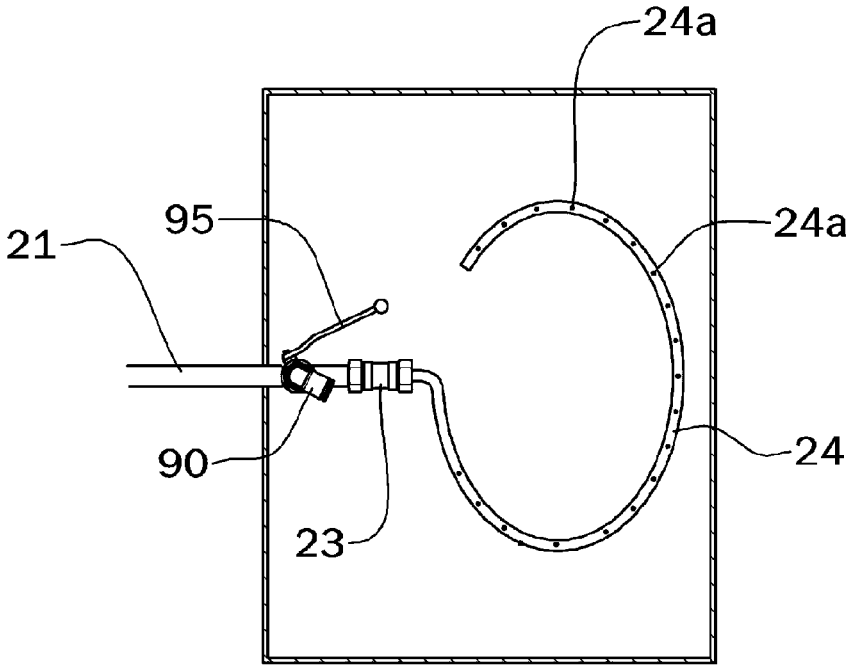

As shown in FIG. 5, the other side of the water supplement tube 21 is arranged to submerge in the interior of the condensation water collection tank 20, and at the front end of the submerged portion is installed a connector 23, and to the connector 23 is connected a discharge and suction header 24 the front end of one side of which is closed, and on the outer surface of the discharge and suction header 24 is provided a plurality of nozzle holes 24*a*.

Figure 6:
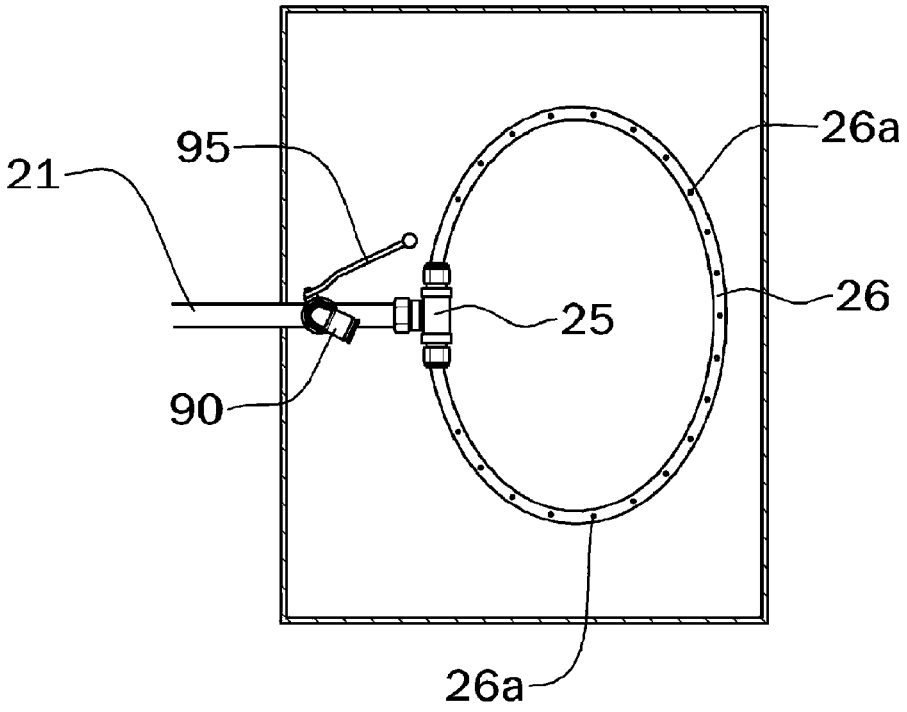

As shown in FIG. 6, the other side of the water supplement tube 21 is arranged to submerge in the interior of the condensation water collection tank 20, and to the front end of the submerged portion is connected a branch tee 25, and to either side of the branch tee 25 is connected a discharge and suction header 26, and on the outer surface of the discharge and suction header 26 are provided a plurality of nozzle holes 26*a*.

The reasons why the plurality of the nozzle holes 21*a*, 24*a* and 26*a* are formed are to release the discharge of the fast increasing vapor pressure so as to prevent noises which occur as water fluctuates while high vapor pressure is discharged to the condensation water collection tank 20. Since the vapor pressure is uniformly distributed over the whole widthwise portions of the condensation water collection tank 20 through the small nozzle holes 21*a*, 24*a* and 26*a* and is discharged, the water rolling can be minimized, which results in reduced noises, while effectively preventing overflow of water to the outside.

In the present invention, as one solution of overcoming the problems in which vacuum pressure resides even after enough water is sucked and supplemented from the condensation water collection tank 20 since the vacuum pressure generating in the pressurization water supply tank 30 is too strong, the air vent 90 is installed at the water supplement tube 21 in a branched state, and as a technical construction, a vacuum pressure adjusting valve 95 is installed at the pipe passage of the air vent 90.

The air vent 90 serves to discharge part of the vapor pressure to the outside while the vapor pressure filled in the steam layer 31 of the pressurization water supply tank 30 is discharged to the condensation water collection tank 20 through the water supplement tube 21 and also serves to introduce the air from the outside when a vacuum pressure occurs in the interior of the pressurization water supply tank 30 for thereby lowering the vacuum pressure, so a proper vacuum degree can be maintained.

In addition, the vacuum pressure adjusting valve 95 helps freely adjust the degree of vacuum in such a way to adjust the input amount of air depending on the operation of its opening and closing degree.

Though the air vent 90 is installed at the pipe passage of the water supplement tube 21, but its installation position is substantially not limited. In the present invention, it is installed at a pipe passage of the water supplement tube 21 provided in the interior of the condensation water collection tank 20, so the vapor pressure discharging through the air vent 90 is not discarded into the air, but is naturally collected into the interior of the condensation water collection tank 20 for thereby avoiding the loss of energy. In particular, an air inlet port 91 formed at the top of the air vent 90 is exposed into an atmospheric layer 20*a* in the interior of the condensation water collection tank 20, so it is possible to reliably introduce the air from the atmospheric layer 20*a* when vacuum pressure occurs in the interior of the pressurization water supply tank 30.

Figure 7:
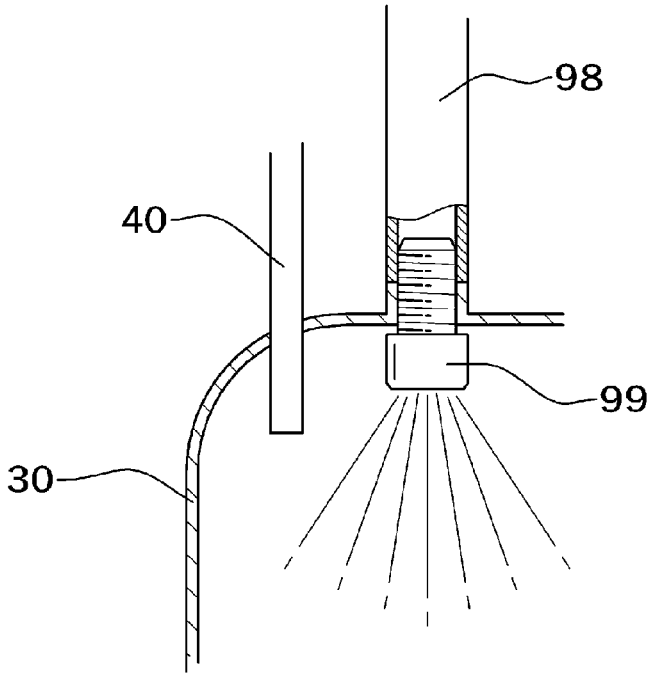
FIG. 7 is an enlarged cross sectional view illustrating a state that a coolant spray tube is installed in a pressurization water supply tank according to the present invention.
Figure 8:
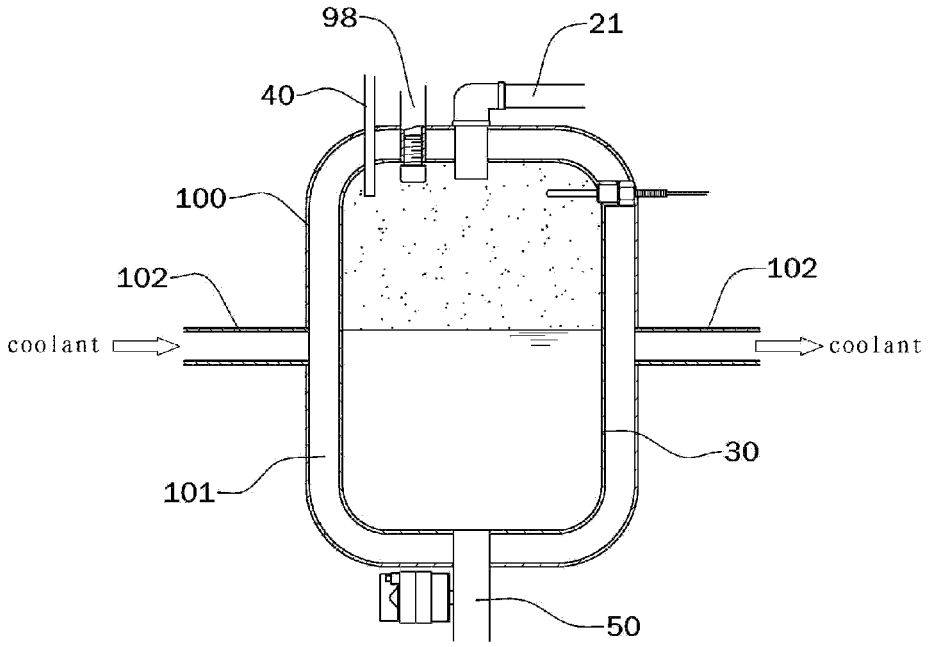
FIG. 8 is a vertical cross sectional view illustrating a state that a coolant jacket is double installed at an outer side of a pressurization water supply tank according to the present invention.

In the present invention, it is possible to further reduce time for which the vacuum pressure generates in the interior of the pressurization water supply tank 30 for thereby implementing a fast supply of supplemental water. As shown in FIG. 7, an additional coolant spray tube 98 is connected to the interior at the top of the pressurization water supply tank 30, and a spray nozzle 99 is provided at a lower side of the coolant spray tube 98.

Therefore, when the vapor pressure filled in the steam layer 31 of the pressurization water supply tank 30 is all discharged to the condensation water collection tank 20, the spray nozzles 99 of the coolant spray tube 98 automatically spray coolants, so liquidation is accelerated, and it is possible to effectively and considerably reduce time for which vacuum pressure generates.

As another method of more reducing time for which vacuum pressure generates in the interior of the pressurization water supply tank 30 in the present invention, instead of the coolant spray tube 98, as shown in FIG. 7, a cooling jacket 100 with a cooling chamber 101 is double installed at an outer side of the pressurization water tank 30, and either side of the cooling jacket 100 is connected a coolant supply tube 102, so the liquidation of the coolant supplied through the coolant supply tube 102 is accelerated through heat exchange while it passes though the cooling chamber 101 for thereby reducing time for which vacuum pressure occurs.

Figure 9:
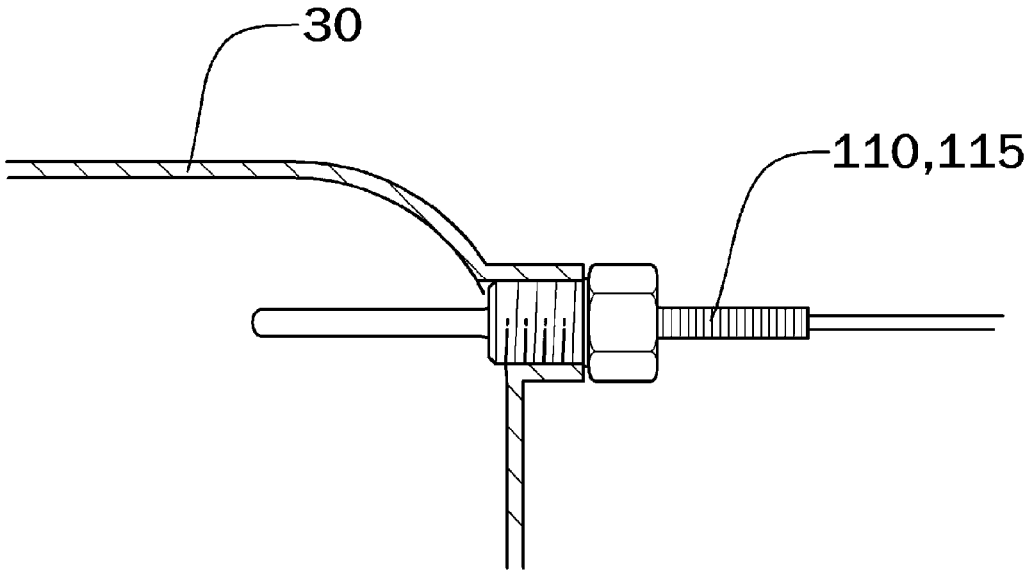
FIG. 9 is an enlarged cross sectional view illustrating a state that a temperature sensor or a pressure sensor is installed in a pressurization water supply tank according to the present invention.

The present invention has features in that the pressurization water supply tank 30, as shown in FIG. 9, is further provided with a temperature sensor 110 or a pressure sensor 115, so that a coolant can be timely sprayed in such a way to transmit a control signal to the controller for the coolant to be sprayed at the immediate moment the temperature sensor 110 or the pressure sensor 115 detects the internal temperature or internal pressure at the accurate moment the vapor pressure filled in the steam layer 31 of the pressurization water supply tank 30 is all discharged to the condensation water collection tank 20.

Figure 10:
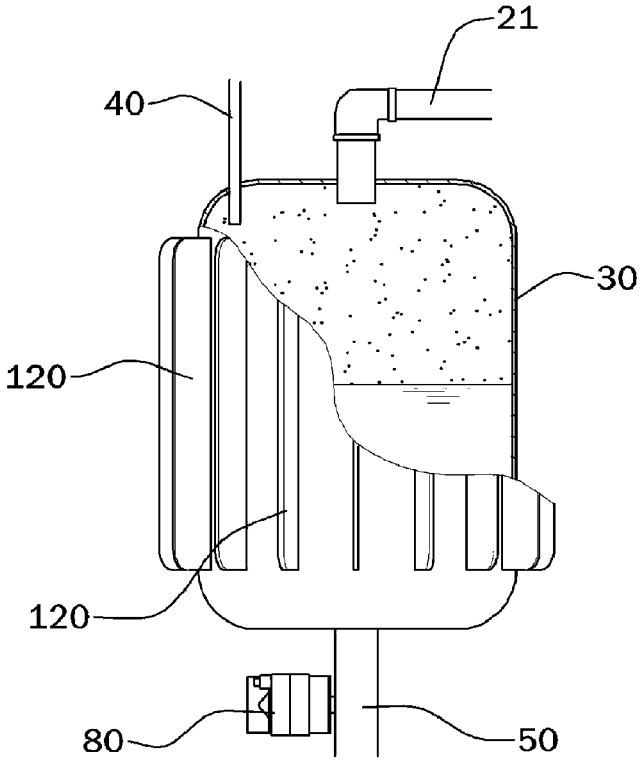
FIG. 10 is a vertical cross sectional view illustrating a partially cut portion in a state that a cooling fin is installed at an outer side of a pressurization water supply tank according to the present invention.
Figure 11:
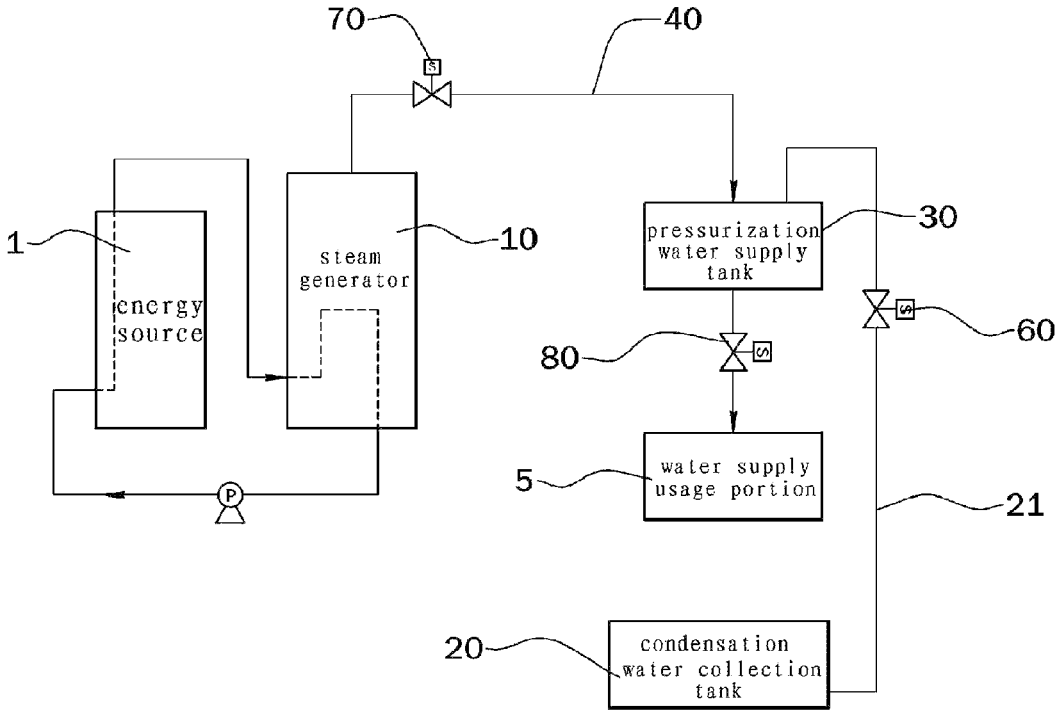
FIG. 11 is a block diagram illustrating in whole the entire constructions of another embodiment of the present invention.

In addition, as shown in FIG. 10, the present invention has features in that as another method of more reducing time for which vacuum pressure occurs in the interior of the pressurization water supply tank 30, instead of the coolant spray tube 98, a plurality of cooling fins 120 may be integrated and protruded in radial directions from the outer surface of the pressurization water supply tank 30, which ensures enhanced cooling efficiency and accelerated liquidation for thereby reducing time for which vacuum pressure occurs.

The present invention with the above described constructions has features in that part of the vapor pressure is supplied to the pressurization water supply tank 30, the water filled in the pressurization water supply tank 30 can be reliably supplied to the steam generator 10, and for this when the water level of the pressurization water supply tank 30 lowers, the water is immediately supplemented from the condensation water collection tank 20.

For this, when the water supplement control valve 60 installed at the water supplement tube 21 is temporarily opened, the high vapor pressure filled in the steam layer 31 of the pressurization water supply tank 30 is directly discharged to the condensation water collection tank 20 through the water supplement tube 21 or as shown in FIG. 4 is discharged through the nozzle holes 21*a* formed at the water supplement tube 21 or as shown in FIGS. 5 and 6 is discharged through an additional discharge and suction header 24 or 26.

As the high vapor pressure is discharge, the temperature of the condensation water collection tank 20 increases, whereas the temperature of the steam layer 31 of the pressurization water supply tank 30 decreases, which consequently causes a liquidation phenomenon, during which liquidation procedure a high vacuum pressure occurs.

The water of the condensation water collection tank 20 may be directly sucked by means of a strong function force generating owing to the above mentioned vacuum pressure or may be sucked through the nozzle holes 21*a* formed at the water supplement tube 21 or may be sucked through additional discharge and suction headers 24 and 26, so the water can be automatically supplemented into the pressurization water supply tank 30.

In the present invention, when the vapor pressure filled in the steam layer 31 of the pressurization water supply tank 30 is all discharged to the condensation water collection tank 20, the spray nozzles 99 of the coolant spray tube 98 automatically spray coolant for thereby accelerating liquidation, so it is possible to effectively and considerably adjust time for which vacuum pressure occurs.

When the water of the pressurization water supply tank 30 reaches the set highest level, the water supplement control valve 60 is automatically closed, so the supply of the water supplement is stopped.

The invention claimed is:

1. An automatic water supply-type steam generator using a vapor pressure, comprising:

a condensation water collection tank which collects spent steam;

a pressurization water supply tank which is installed through the condensation water collection tank and a water supplement tube;

a vapor pressure supply tube connected between the pressurization water supply tank and a steam generator;

a water supply tube which is connected either between the pressurization water supply tank and the steam generator or between the pressurization water supply tank and a water supply usage portion;

a water supplement control valve installed at a pipe conduit of the water supplement tube;

a pressure supply control valve which is installed at a pipe conduit of the vapor pressure supply tube;

a water supply control valve which is installed at a pipe conduit of the water supply tube; and an air vent which is branched and installed at the water supplement tube so as to adjust an internal vacuum pressure of the pressurization water supply tank and which has a vacuum pressure adjusting valve which is installed at a pipe conduit.

2. The automatic water supply-type steam generator using a vapor pressure according to claim 1, wherein the air vent is installed at a pipe conduit of the water supplement tube positioned in the interior of the condensation water collection tank and serves to collect a vapor pressure discharged through the air vent into the interior of the condensation water collection tank, and an air inlet port formed at the top of the air vent is exposed to an atmospheric layer of the interior of the condensation water collection tank.

3. The automatic water supply-type steam generator using a vapor pressure according to claim 2, wherein one side of the water supplement tube is connected to the top of the pressurization water supply tank, and the other side of the same is arranged to submerge in the interior of the condensation water collection tank, and the front end of the submerged portion is open.

4. The automatic water supply-type steam generator using a vapor pressure according to claim 2, wherein one side of the water supplement tube is connected to the top of the pressurization water supply tank, and the other side of the same is arranged to submerge in the interior of the condensation water collection tank, and the front end of the submerged portion is sealed, and a plurality of nozzle holes are formed on an outer surface.

5. The automatic water supply-type steam generator using a vapor pressure according to claim 2, wherein one side of the water supplement tube is connected to the top of the pressurization water supply tank, and the other side of the same is arranged to submerge in the interior of the condensation water collection tank, and to a connector installed at a front end of the submerged portion is connected a discharge and suction header a front end of one side of which is sealed, and on an outer surface of the discharge and suction header are formed a plurality of nozzle holes.

6. The automatic water supply-type steam generator using a vapor pressure according to claim 1, wherein one side of the water supplement tube is connected to the top of the pressurization water supply tank, and the other side of the same is arranged to submerge in the interior of the condensation water collection tank, and the front end of the submerged portion is open.

7. The automatic water supply-type steam generator using a vapor pressure according to claim 1, wherein one side of the water supplement tube is connected to the top of the pressurization water supply tank, and the other side of the same is arranged to submerge in the interior of the condensation water collection tank, and the front end of the submerged portion is sealed, and a plurality of nozzle holes are formed on an outer surface.

8. The automatic water supply-type steam generator using a vapor pressure according to claim 1, wherein one side of the water supplement tube is connected to the top of the pressurization water supply tank, and the other side of the same is arranged to submerge in the interior of the condensation water collection tank, and to a connector installed at a front end of the submerged portion is connected a discharge and suction header a front end of one side of which is sealed, and on an outer surface of the discharge and suction header are formed a plurality of nozzle holes.

9. The automatic water supply-type steam generator using a vapor pressure according to claim 1, wherein one side of the water supplement tube is connected to the top of the pressurization water supply tank, and the other side of the same is arranged to submerge in the interior of the condensation water collection tank, and a branch tee is connected to a front end of the submerged portion, and to either side of the branch tee is connected a discharge and suction header, and on an outer surface of the discharge and suction header are formed a plurality of nozzle holes.

10. The automatic water supply-type steam generator using a vapor pressure according to claim 1, wherein the pressurization water supply tank comprises either a temperature sensor or a pressure sensor.

11. The automatic water supply-type steam generator using a vapor pressure, comprising:

a condensation water collection tank which collects spent steam;

a pressurization water supply tank which is installed through the condensation water collection tank and a water supplement tube;

a vapor pressure supply tube connected between the pressurization water supply tank and a steam generator;

a water supply tube which is connected either between the pressurization water supply tank and the steam generator or between the pressurization water supply tank and a water supply usage portion;

a water supplement control valve installed at a pipe conduit of the water supplement tube;

a pressure supply control valve which is installed at a pipe conduit of the vapor pressure supply tube;

a water supply control valve which is installed at a pipe conduit of the water supply tube; and a coolant spray tube which is connected to the interior and is installed at the top of the pressurization water supply tank so as to reduce time for which a vacuum pressure occurs in the interior of the pressurization water supply tank and which automatically sprays coolant when the vapor pressure filled in a steam layer of the pressurization water supply tank is all discharged to the condensation water collection tank.

12. The automatic water supply-type steam generator using a vapor pressure according to claim 11, wherein one side of the water supplement tube is connected to the top of the pressurization water supply tank, and the other side of the same is arranged to submerge in the interior of the condensation water collection tank, and the front end of the submerged portion is open.

13. The automatic water supply-type steam generator using a vapor pressure according to claim 11, wherein one side of the water supplement tube is connected to the top of the pressurization water supply tank, and the other side of the same is arranged to submerge in the interior of the condensation water collection tank, and the front end of the submerged portion is sealed, and a plurality of nozzle holes are formed on an outer surface.

14. The automatic water supply-type steam generator using a vapor pressure according to claim 11, wherein one side of the water supplement tube is connected to the top of the pressurization water supply tank, and the other side of the same is arranged to submerge in the interior of the condensation water collection tank, and to a connector installed at a front end of the submerged portion is connected a discharge and suction header a front end of one side of which is sealed, and on an outer surface of the discharge and suction header are formed a plurality of nozzle holes.

15. The automatic water supply-type steam generator using a vapor pressure, comprising:

a condensation water collection tank which is installed lower than the position of a steam generator and serves to collect spent steam;

a pressurization water supply tank which is connected through the condensation water collection tank and a water supplement tube;

a vapor pressure supply tube connected between the steam generator and the pressurization water supply tank;

a water supply tube which is connected either between the pressurization water supply tank and the steam generator or between the pressurization water supply tank and a water supply usage portion;

a water supplement control valve installed at a pipe conduit of the water supplement tube;

a pressure supply control valve installed at a pipe conduit of the vapor pressure supply tube;

a water supply control valve installed at a pipe conduit of the water supply tube; and a cooling jacket which is double installed at an outer side of the pressurization water supply tank so as to reduce time for which vacuum pressure occurs in the interior of the pressurization water supply tank and which has a cooling chamber in its interior and a coolant supply tube connected to its either side.

16. The automatic water supply-type steam generator using a vapor pressure according to claim 15, wherein one side of the water supplement tube is connected to the top of the pressurization water supply tank, and the other side of the same is arranged to submerge in the interior of the condensation water collection tank, and the front end of the submerged portion is open.

17. The automatic water supply-type steam generator using a vapor pressure according to claim 15, wherein one side of the water supplement tube is connected to the top of the pressurization water supply tank, and the other side of the same is arranged to submerge in the interior of the condensation water collection tank, and the front end of the submerged portion is sealed, and a plurality of nozzle holes are formed on an outer surface.

18. The automatic water supply-type steam generator using a vapor pressure, comprising:

a condensation water collection tank which is installed lower than the position of a steam generator and serves to collect spent steam;

a pressurization water supply tank which is connected through the condensation water collection tank and a water supplement tube;

a vapor pressure supply tube connected between the steam generator and the pressurization water supply tank;

a water supply tube which is connected either between the pressurization water supply tank and the steam generator or between the pressurization water supply tank and a water supply usage portion;

a water supplement control valve installed at a pipe conduit of the water supplement tube;

a pressure supply control valve installed at a pipe conduit of the vapor pressure supply tube;

a water supply control valve installed at a pipe conduit of the water supply tube; and a plurality of cooling fins which protrude in radial directions from an outer surface of the pressurization water supply tank so as to reduce time for which a vacuum pressure occurs in the interior of the pressurization water supply tank.

19. The automatic water supply-type steam generator using a vapor pressure according to claim 18, wherein one side of the water supplement tube is connected to the top of the pressurization water supply tank, and the other side of the same is arranged to submerge in the interior of the condensation water collection tank, and the front end of the submerged portion is open.

20. The automatic water supply-type steam generator using a vapor pressure according to claim 18, wherein one side of the water supplement tube is connected to the top of the pressurization water supply tank, and the other side of the same is arranged to submerge in the interior of the condensation water collection tank, and the front end of the submerged portion is sealed, and a plurality of nozzle holes are formed on an outer surface.

* * * * *